US006858098B2

(12) United States Patent
Oshima et al.

(10) Patent No.: US 6,858,098 B2
(45) Date of Patent: Feb. 22, 2005

(54) PROCESSING SOLUTION FOR FORMING HEXAVALENT CHROMIUM FREE AND CORROSION RESISTANT CONVERSION FILM ON ZINC OR ZINC ALLOY PLATING LAYERS, HEXAVALENT CHROMIUM FREE AND CORROSION RESISTANT CONVERSION FILM, METHOD FOR FORMING THE SAME

(75) Inventors: Katsuhide Oshima, Tokyo (JP); Shigemi Tanaka, Tokyo (JP); Manabu Inoue, Tokyo (JP); Tomitaka Yamamoto, Tokyo (JP)

(73) Assignee: Dipsol Chemicals Co., Ltd., Tokyo (JP)

( * ) Notice: Subject to any disclaimer, the term of this patent is extended or adjusted under 35 U.S.C. 154(b) by 0 days.

(21) Appl. No.: 10/085,083

(22) Filed: Mar. 1, 2002

(65) Prior Publication Data

US 2003/0148122 A1 Aug. 7, 2003

(30) Foreign Application Priority Data

Nov. 30, 2001 (JP) ..... 2001-366717

(51) Int. Cl.[7] ..... C23C 22/46
(52) U.S. Cl. ..... 148/267; 148/265
(58) Field of Search ..... 148/243, 265, 148/267

(56) References Cited

U.S. PATENT DOCUMENTS

| | | | | |
|---|---|---|---|---|
| 4,349,392 A | * | 9/1982 | Huvar | 148/266 |
| 4,359,345 A | | 11/1982 | Da Fonte, Jr. | |
| 4,578,122 A | | 3/1986 | Crotty | |
| 5,368,655 A | | 11/1994 | Klos | |
| 5,582,709 A | | 12/1996 | Oshima et al. | |
| 5,630,929 A | | 5/1997 | Oshima et al. | |
| 5,743,971 A | | 4/1998 | Inoue et al. | |
| 5,938,861 A | | 8/1999 | Inoue et al. | |
| 6,287,704 B1 | | 9/2001 | Preikschat et al. | |
| 2001/0017293 A1 | | 8/2001 | Nasu et al. | |

FOREIGN PATENT DOCUMENTS

| | | |
|---|---|---|
| EP | 1 032 100 | 8/2000 |
| EP | 1 128 508 | 8/2001 |
| JP | 54-142141 | 11/1979 |
| JP | 57-181379 | 11/1982 |
| JP | 63-15991 | 4/1988 |
| JP | 3-10714 | 2/1991 |
| JP | 11-335865 | 12/1999 |
| JP | 2000-509434 | 7/2000 |
| JP | 2000-234177 | 8/2000 |
| JP | 2000-282255 | 10/2000 |
| WO | WO 97/40208 | 10/1997 |

OTHER PUBLICATIONS

Dictionary of Organic Compounds, sixth edition, vol. five, Chapman & Hall, 1996, p. 4965.*
Merriam–Webster's Collegiate Dictionary, tenth edition, Merriam–Webster Incorporated, 1998, p. 172.*
The ASM Handbook, vol. 13: Corrosion, "Chromate Conversion Coatings: Technology of Chromating Processes", 1992, pp. 1–3.*

* cited by examiner

*Primary Examiner*—Roy King
*Assistant Examiner*—Harry D. Wilkins, III
(74) *Attorney, Agent, or Firm*—Oblon, Spivak, McClelland, Maier & Neustadt, P.C.

(57) ABSTRACT

A processing solution for forming a hexavalent chromium free, corrosion resistant trivalent chromate conversion film on zinc or zinc alloy plating layers comprises: trivalent chromium and oxalic acid in a molar ratio ranging from 0.5/1 to 1.5/1, wherein the trivalent chromium is present in the form of a water-soluble complex with oxalic acid; and cobalt ions, which do not form a hardly soluble metal salt with oxalic acid and are stably present in the processing solution without causing any precipitation; wherein the solution reacts with zinc when bringing it into contact with the zinc or zinc alloy plating to form a hexavalent chromium free, corrosion resistant, trivalent chromate conversion film containing zinc, chromium, cobalt, oxalic acid and silicon on the plating. The film is quite thin, free of any hexavalent chromium, has corrosion resistance identical to or higher than that achieved by the conventional hexavalent chromium-containing film and can be formed using a processing solution having a quite low concentration.

16 Claims, 2 Drawing Sheets pH curves

PROCESSING SOLUTION FOR FORMING HEXAVALENT CHROMIUM FREE AND CORROSION RESISTANT CONVERSION FILM ON ZINC OR ZINC ALLOY PLATING LAYERS, HEXAVALENT CHROMIUM FREE AND CORROSION RESISTANT CONVERSION FILM, METHOD FOR FORMING THE SAME

BACKGROUND OF THE INVENTION

The present invention relates to a processing solution for forming a hexavalent chromium free and corrosion resistant conversion film on zinc or zinc alloy plating layers, a hexavalent chromium free and corrosion resistant conversion film and a method for forming the hexavalent chromium free and corrosion resistant conversion film.

As methods for rust preventing the surface of a metal, there has been known a zinc or zinc alloy-plating method. However, it is not possible to ensure sufficient corrosion resistance of the metal by such plating alone. For this reason, there has widely been adopted, in this industrial field, the treatment with chromic acid containing hexavalent chromium or the so-called chromate treatment after the plating. Nevertheless, it has recently been pointed out that the hexavalent chromium may adversely affect the human body and the environment and there has correspondingly been such a strong and active trend that the use of hexavalent chromium should be controlled.

As one of the substituent techniques therefor, the formation of a corrosion resistant conversion film, in which trivalent chromium is used, has been known. For instance, Japanese Examined Patent Publication (hereunder referred to as "J.P. KOKOKU") No. Sho 63-015991 discloses a method, which comprises the step of treating the surface of a metal with a bath containing a mixture of trivalent chromium and a fluoride, an organic acid, an inorganic acid and/or a metal salt such as cobalt sulfate. However, a fluoride is used in this plating bath and therefore, a problem of environmental pollution would arise. In addition, J.P. KOKOKU No. Hei 03-010714 discloses a method, which makes use of a plating bath comprising a mixture of trivalent chromium and an oxidizing agent, an organic acid, an inorganic acid and/or a metal salt such as a cerium salt. However, this method makes use of an oxidizing agent and cerium and therefore, the trivalent chromium may possibly be oxidized into hexavalent chromium, during the processing and/or the storage of the bath.

Furthermore, Japanese Un-Examined Patent Publication (hereunder referred to as "J.P. KOKAI") No. 2000-509434 discloses a method, which comprises the step of treating the surface of a metal using a plating bath comprising 5 to 100 g/L of trivalent chromium and nitrate residues, an organic acid and/or a metal salt such as a cobalt salt. This method uses, for instance, trivalent chromium in a high concentration and the plating operation is carried out at a high temperature. Therefore, this method is advantageous in that it can form a thick film and ensure good corrosion resistance. However, the method suffers from a problem in that it is difficult to stably form a dense film and that the method cannot ensure the stable corrosion resistance of the resulting film. Moreover, the processing bath contains trivalent chromium in a high concentration and also contains a large amount of an organic acid. This makes the post-treatment of the waste water difficult and results in the formation of a vast quantity of sludge after the processing. Although one can recognize that it is advantageous to use a processing solution free of any hexavalent chromium for ensuring the environmental protection, the method suffers from a serious problem in that it may give a new burden to the environment such that the method generates a vast quantity of waste.

Moreover, there have been proposed a method for processing the surface of a metal with a bath containing trivalent chromium in a low concentration and an organic acid and a metal salt such as a nickel salt (U.S. Pat. No. 4,578,122) and a processing method, which makes use of a bath containing trivalent chromium in a low concentration and an organic acid (U.S. Pat. No. 5,368,655). However, these methods never ensure sufficient corrosion resistance of the resulting film as compared with the conventional hexavalent chromate treatment.

As has been discussed above in detail, it has been known that if zinc or a zinc alloy is immersed in a solution of a trivalent chromium salt, a chromium-containing film is formed thereon.

However, the resulting film is insufficient in the corrosion resistance effect. Therefore, it is necessary to increase the thickness of the resulting film by increasing the chromium concentration in the processing solution, raising the processing temperature and extending the processing time in order to obtain a film having the corrosion resistance effect identical to that achieved by the conventional corrosion resistant conversion film derived from hexavalent chromium. However, this leads to an increase in the energy consumption and in the quantity of the waste sludge, which is not desirable from the viewpoint of the environmental protection.

SUMMARY OF THE INVENTION

Accordingly, it is an object of the present invention to provide a thin, hexavalent chromium free film, which is applied onto the surface of zinc or zinc alloy plating layers, which have corrosion resistance identical to or higher than that achieved by the conventional hexavalent chromium-containing conversion film and which can be formed using a processing solution having a low concentration. More specifically, it is an object of the present invention to provide a hexavalent chromium free, corrosion resistance, trivalent chromate-conversion film excellent, in particular, in corrosion resistance after heating.

Another object of the present invention is to provide a processing solution used for forming such a hexavalent chromium free, corrosion resistance, trivalent chromate-conversion film and a method for forming the film.

Moreover, it is also an object of the present invention to provide a method for forming such a film in which the same devices and processes used in the formation of the conventional hexavalent chromate film can be used as such without any modification, more specifically under the following processing conditions: a processing temperature ranging from 20 to 30° C. and a processing time ranging from 20 to 60 seconds.

The present invention has been completed on the basis of such finding that the foregoing problems associated with the conventional techniques can effectively be solved by depositing a zinc plating layer on a substrate and then subjecting the plating layer to a trivalent chromate treatment using a processing solution having a specific composition.

According to an aspect of the present invention, there is provided a processing solution for forming a hexavalent chromium free, corrosion resistance trivalent chromate film on zinc or zinc alloy plating layers and the processing solution comprises:

trivalent chromium and oxalic acid in a mole ratio ranging from 0.5/1 to 1.5/1, wherein the trivalent chromium is present in the form of a water-soluble complex with oxalic acid; and cobalt ions are stably present in the processing solution without causing any precipitation by forming a hardly soluble metal salt with oxalic acid;

wherein the solution reacts with zinc when bringing it into contact with the zinc or zinc alloy plating to form a hexavalent chromium free, corrosion resistance, trivalent chromate film containing zinc, chromium, cobalt and oxalic acid on the plating.

According to another aspect of the present invention, there is provided the foregoing hexavalent chromium free, corrosion resistance, trivalent chromate conversion film containing zinc, chromium, cobalt or oxalic acid and formed on zinc or zinc alloy plating layers, wherein the mass ratio of chromium to (chromium+zinc) [Cr/(Cr+Zn)] is not less than 15/100, the mass ratio of cobalt to (chromium+cobalt) [Co/(Cr+Co)] ranges from 5/100 to 40/100 and the mass ratio of the oxalic acid to (chromium+oxalic acid) [oxalic acid/(Cr+oxalic acid)] ranges from 5/100 to 50/100.

According to a further aspect of the present invention, there is provided a method for forming a hexavalent chromium free, corrosion resistance, trivalent chromate conversion film, which comprises the step of bringing zinc or zinc alloy plating into contact with the foregoing processing solution.

DESCRIPTION OF THE PREFERRED EMBODIMENTS

Figure 1:
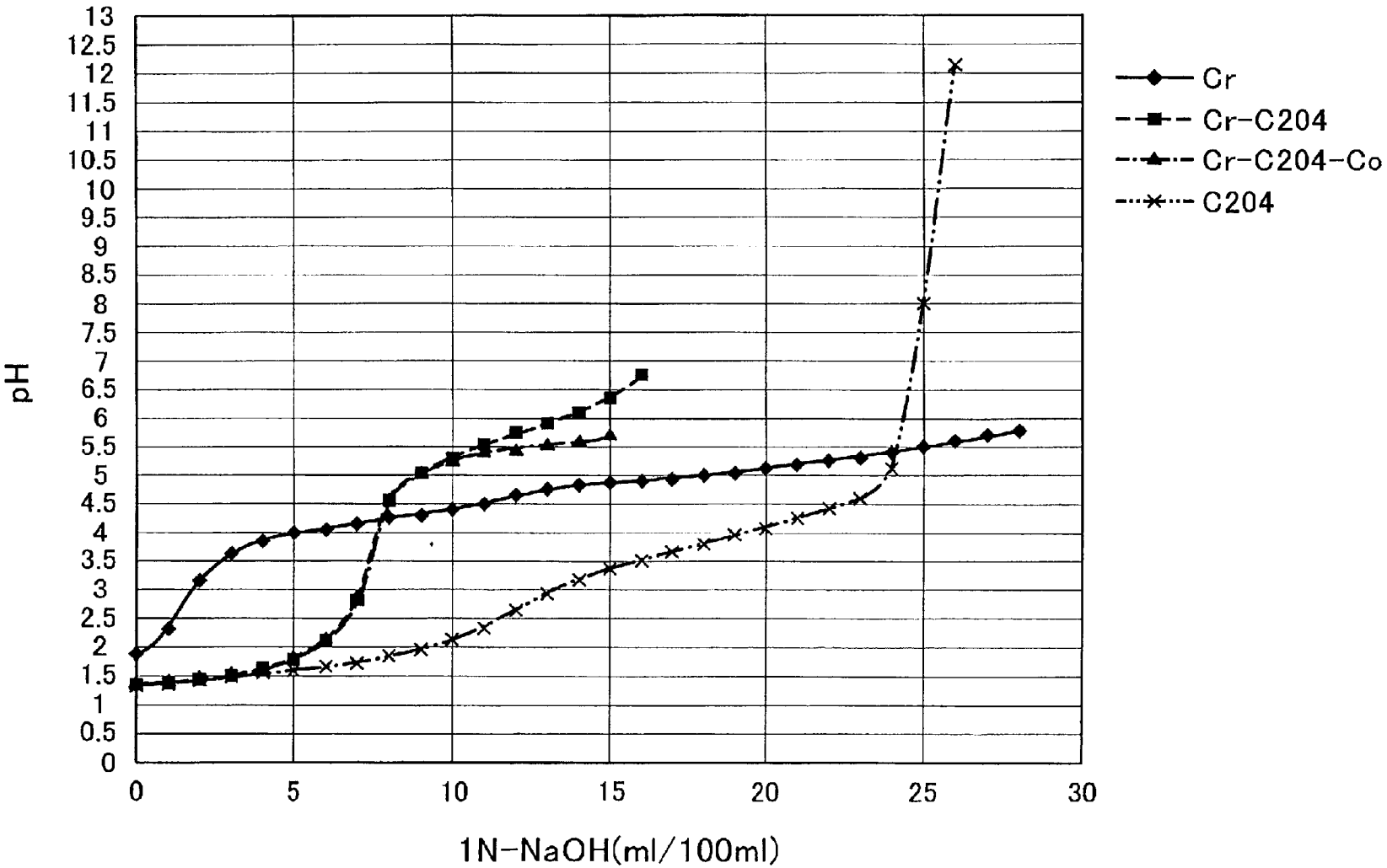
FIG. 1 is a graph showing pH curves of Cr, an oxalic acid-Cr system, an oxalic acid-Cr—Co system and oxalic acid.

The substrates used in the present invention may be a variety of metals such as iron, nickel and copper, alloys thereof and metals or alloys such as aluminum, which have been subjected to zincate treatment and the substrate may have a variety of shapes such as plate-like, rectangular prism-like, column-like, cylindrical and spherical shapes.

The foregoing substrate is plated with zinc or a zinc alloy according to the usual method. The zinc-plating layer may be deposited on the substrate using either of baths, for instance, acidic baths such as a sulfuric acid bath, an ammonium chloride bath and a potassium chloride bath, and alkaline baths such as an alkaline non-cyanide bath and an alkaline cyanide bath.

In addition, examples of zinc alloy plating are zinc-iron alloy plating, zinc-nickel alloy plating having a rate of nickel-co-deposition ranging from 5 to 20% by mass, zinc-cobalt alloy plating and tin-zinc alloy plating. The thickness of the zinc or zinc alloy plating to be deposited on the substrate may arbitrarily be selected, but it is desirably not less than 1 $\mu$m and preferably 5 to 25 $\mu$m.

In the present invention, after the zinc or zinc alloy plating is deposited on a substrate according to the foregoing method, the plated substrate is water rinsed, if desired, immersed into a dilute nitric acid solution and then brought into contact with a processing solution for forming a trivalent chromate film according to the present invention, for instance, subjected to a dipping treatment using this processing solution.

In the foregoing processing solution of the present invention, the source of the trivalent chromium may be any chromium compound containing trivalent chromium, but preferred examples thereof usable herein are trivalent chromium salts such as chromium chloride, chromium sulfate, chromium nitrate, chromium phosphate and chromium acetate or it is also possible to reduce hexavalent chromium such as chromic acid or dichromic acid into trivalent chromium using a reducing agent. The foregoing sources of trivalent chromium may be used alone or in any combination of at least two of them. The concentration of trivalent chromium in the processing solution is preferably as low as possible from the viewpoint of the easiness of the waste water treatment, but it is preferably 0.2 to 5 g/L and most preferably 1 to 5 g/L, while taking into account the corrosion resistance. In the present invention, the use of trivalent chromium in such a low concentration falling within the range specified above is also quite advantageous from the viewpoint of the waste water treatment and the processing cost.

Moreover, sources of oxalic acid usable herein are oxalic acid and salts thereof (such as sodium, potassium and ammonium salts), which may be used alone or in any combination of at least two of them. The concentration of oxalic acid used herein preferably ranges from 0.2 to 13 g/L and more preferably 2 to 11 g/L.

The cobalt ion sources usable herein may be any cobalt compound containing bivalent cobalt and specific examples thereof preferably used herein are cobalt nitrate, cobalt sulfate and cobalt chloride. The cobalt ion concentration in the processing solution preferably ranges from 0.2 to 10 g/L and more preferably 0.5 to 8 g/L. The cobalt ion concentration is desirably not less than 2.0 g/L, in particular, to improve corrosion resistance after heating of the resulting conversion film. The amount of cobalt present in the resulting film increases as the cobalt ion concentration present in the processing solution increases and the corrosion resistance of the resulting conversion film is improved in proportion thereto.

The molar ratio of trivalent chromium to oxalic acid present in the processing solution preferably ranges from 0.5/1 to 1.5/1 and more preferably 0.8/1 to 1.3/1.

In addition, the foregoing processing solution may additionally comprise an inorganic salt selected from the group consisting of inorganic salts of nitric acid, sulfuric acid and hydrochloric acid. The inorganic acid (hydrochloric acid, sulfuric acid, nitric acid) ions present in the processing solution preferably ranges from 1 to 50 g/L and more preferably 5 to 20 g/L.

In addition to the foregoing components, the processing solution may likewise comprise at least one member selected from the group consisting of phosphorus oxyacids such as phosphoric acid and phosphorous acid and alkali salts thereof. The concentration of these components preferably ranges from 0.1 to 50 g/L and more preferably 0.5 to 20 g/L.

It is also possible to add, to the processing solution, a dicarboxylic acid such as malonic acid or succinic acid, an oxycarboxylic acid such as citric acid, tartaric acid or malic acid, and/or a polyvalent carboxylic acid such as tricarballylic acid. The concentration thereof to be incorporated into the processing solution preferably falls within the range of 1 to 30 g/L.

The pH value of the processing solution of the present invention is preferably adjusted to the range of 0.5 to 4 and more preferably 2 to 2.5. In this respect, it is possible to use ions of the foregoing inorganic acids or an alkaline agent such as an alkali hydroxide or aqueous ammonia in order to adjust the pH value thereof to the range specified above.

The rest (balance) of the processing solution used in the present invention, except for the foregoing essential components, is water.

The trivalent chromium and oxalic acid should be present in the processing solution in the form of a stable water-soluble complex formed therebetween, which is supposed to have a structure represented by the following general formula, while cobalt ions should stably exist in the solution without causing any precipitation by forming a hardly soluble metal salt with oxalic acid.

$$[(Cr)_1.(C_2O_4)_m.(H_2O)_n]^{+(n-3)}$$

wherein the molar ratio of Cr to oxalic acid satisfies the relations: 0.5<m/l<1.5 and n=6–2 m/l and there is not any restriction in the counter ions.

For instance, if the foregoing stable complex is not formed in the solution or excess oxalic acid ions are present in the processing solution, cobalt ions react with oxalic acid present in the processing solution in its free state to thus form precipitates of cobalt oxalate. As a result, the processing solution cannot form any chemical conversion film (coating) having excellent corrosion resistance.

If zinc or zinc alloy plating is brought into contact with the processing solution according to the present invention, the components of the solution react with zinc to thus form a hexavalent chromium free, corrosion resistance, trivalent chromate film comprising zinc, chromium, cobalt and oxalic acid on the zinc or zinc alloy plating.

The hexavalent chromium free, corrosion resistance, trivalent chromate film according to the present invention, which is formed by bringing zinc or zinc alloy plating into contact with the foregoing processing solution, comprises zinc, chromium, cobalt and oxalic acid.

The mass rate of chromium relative to (chromium+zinc) [Cr/(Cr+Zn)] in the resulting film is not less than 15/100 and preferably 20/100 to 60/100.

The mass rate of cobalt relative to (chromium+cobalt) [Co/(Cr+Co)] in the resulting film ranges from 5/100 to 40/100 and preferably 10/100 to 40/100.

The mass rate of oxalic acid relative to (chromium+oxalic acid) [oxalic acid/(Cr+oxalic acid)] in the resulting film ranges from 5/100 to 50/100 and preferably 10/100 to 50/100.

The resulting film has the high corrosion resistance after heating when the thickness of the resulting film is not less than 0.02 $\mu$m and preferably 0.02 to 0.08 $\mu$m.

As the method for bringing the zinc or zinc alloy plating into contact with the foregoing processing solution according to the present invention, it is usual to immerse an article plated with zinc or zinc alloy in the foregoing processing solution. For instance, such an article is immersed in the solution maintained at a temperature ranging from 10 to 40° C. and more preferably 20 to 30° C. for preferably 5 to 600 seconds and more preferably 20 to 60 seconds.

In this connection, the subject to be treated is in general immersed in a dilute nitric acid solution in order to improve the luster of the resulting trivalent chromate film, before it is subjected to the trivalent chromate treatment. However, such a pre-treatment may be used or may not be used in the present invention.

The conditions and processing operations other than those described above may be determined or selected in accordance with the conventional hexavalent chromate processing.

Moreover, a topcoat film may be applied onto the hexavalent chromium free, corrosion resistance, trivalent chromate film and this would permit the further improvement of the corrosion resistance of the film. In other words, this is a quite effective means for imparting more excellent corrosion resistance to the film. For instance, the zinc or zinc alloy plating is first subjected to the foregoing trivalent chromate treatment, followed by washing, the plating with water, subjecting the plating to immersion or electrolyzation in a topcoating solution and then drying the processed article. Alternatively, the article is subjected to immersion or electrolyzation in a topcoating solution after the trivalent chromate treatment and the subsequent drying treatment, and then dried. The term "topcoat" effectively used herein means not only an inorganic film of, for instance, a silicate or a phosphoric acid salt, but also an organic film of, for instance, polyethylene, polyvinyl chloride, polystyrene, polypropylene, methacrylic resin, polycarbonate, polyamide, polyacetal, fluorine plastic, urea resin, phenolic resin, unsaturated polyester resin, polyurethane, alkyd resin, epoxy resin or melamine resin.

The topcoating liquids for forming such an topcoat film usable herein may be, for instance, DIPCOAT W available from Dipsol Chemicals Co., Ltd. The thickness of the topcoat film may arbitrarily be selected, but it desirably ranges from 0.1 to 30 $\mu$m.

Moreover, a dye may be incorporated into the processing solution or the plating layers may once be treated with the processing solution and then the trivalent chromate conversion film may be treated with a liquid containing a dye, in order to pigment the trivalent chromate film.

Reaction Mechanism of Film-Formation

The reaction mechanism of the trivalent chromate conversion film-formation according to the present invention can be supposed to be as follows:

(i) The occurrence of a Zn dissolution reaction by the action of hydrogen ions and an oxidizing agent such as nitric acid;

(ii) The consumption of hydrogen ions and an increase of the pH value at the interface to be plated subsequent to the dissolution reaction:

$$Zn \rightarrow Zn^{2+}+2e^-,\ 2H^++2e^- \rightarrow 2H,\ 2H+\tfrac{1}{2}O_2 \rightarrow H_2O \text{ (an increase in the pH value);}$$

(iii) The reduction of the stability of the Cr (trivalent)-oxalic acid chelate, the formation and deposition of Cr hydroxide, and the generation of excess oxalic acid (in case of 1/m=1), due to the increase in the pH value:

$$[CrC_2O_4.(H_2O)_4]^+ \rightarrow Cr(OH)_3\downarrow + C_2O_4^{2-} + 3\ H^+ + H_2O;$$

(iv) The formation and deposition of a hardly soluble metal salt through the reaction of the excess oxalic acid with cobalt ions:

$$C_2O_4^{2-} + Co^{2-} \rightarrow CoC_2O_4\downarrow;$$

(v) These reactions are repeated by the stirring operation to thus cause the growth of the film.

The pH curves shown in FIG. 1 would support these reaction mechanisms. As will be seen from the pH curves observed for oxalic acid and for the oxalic acid-Cr system, the stable complex of oxalic acid with Cr loses its stability at a pH value of not less than about 4.5. In addition, the pH curve observed for the oxalic acid-Cr—Co system likewise indicates that precipitates of Co are also formed at a pH level of not less than about 4.5.

Moreover, it would be predicted from the following experimental results that insoluble cobalt oxalate is formed during the film-formation.

Experiment 1: Any precipitate is not formed even when a Co salt is added to a stable oxalic acid-Cr complex solution.

Experiment 2: Any precipitate is not formed even when oxalic acid is further added to a stable oxalic acid-Cr complex solution.

Experiment 3: If an additional oxalic acid is added to the liquid of Experiment 1 (Co ions are present therein), precipitates are formed.

Experiment 4: If a Co salt is added to the liquid of Experiment 2 (excess oxalic acid ions are present therein), precipitates are formed.

Experiment 5: (In case where any chelate is not formed), if a Co salt is added to an oxalic acid solution, precipitates are formed.

Results Obtained in the Analysis of Films

As has been discussed above, in the trivalent chromate film of the present invention, cobalt oxalate having quite low solubility in water is formed at the interface of the plated film during the reaction for forming the chemical conversion film and therefore, the oxalate is incorporated into the trivalent chromium-containing chemical conversion film during the formation thereof to make the resulting film dense and to thus give a firm corrosion resistant film.

In fact, when using a solution having a ratio: chromium: oxalic acid=1:1 (molar ratio) and containing cobalt ions, the results listed in the following Table 1 are obtained by analyzing the resulting trivalent chromate film. It is certainly confirmed that the resulting film comprises oxalic acid ions and cobalt. Moreover, the result as calculated from the molar ratio is approximately in consistent with cobalt oxalate ($C_2O_4$).

TABLE 1

| Cr (mg/dm$^2$) | Co (mg/dm$^2$) | $C_2O_4^{2-}$(mg/dm$^2$) | Thickness of the Film |
|---|---|---|---|
| 0.5 | 0.07 | 0.12 | 0.08 $\mu$m |

Figure 2:
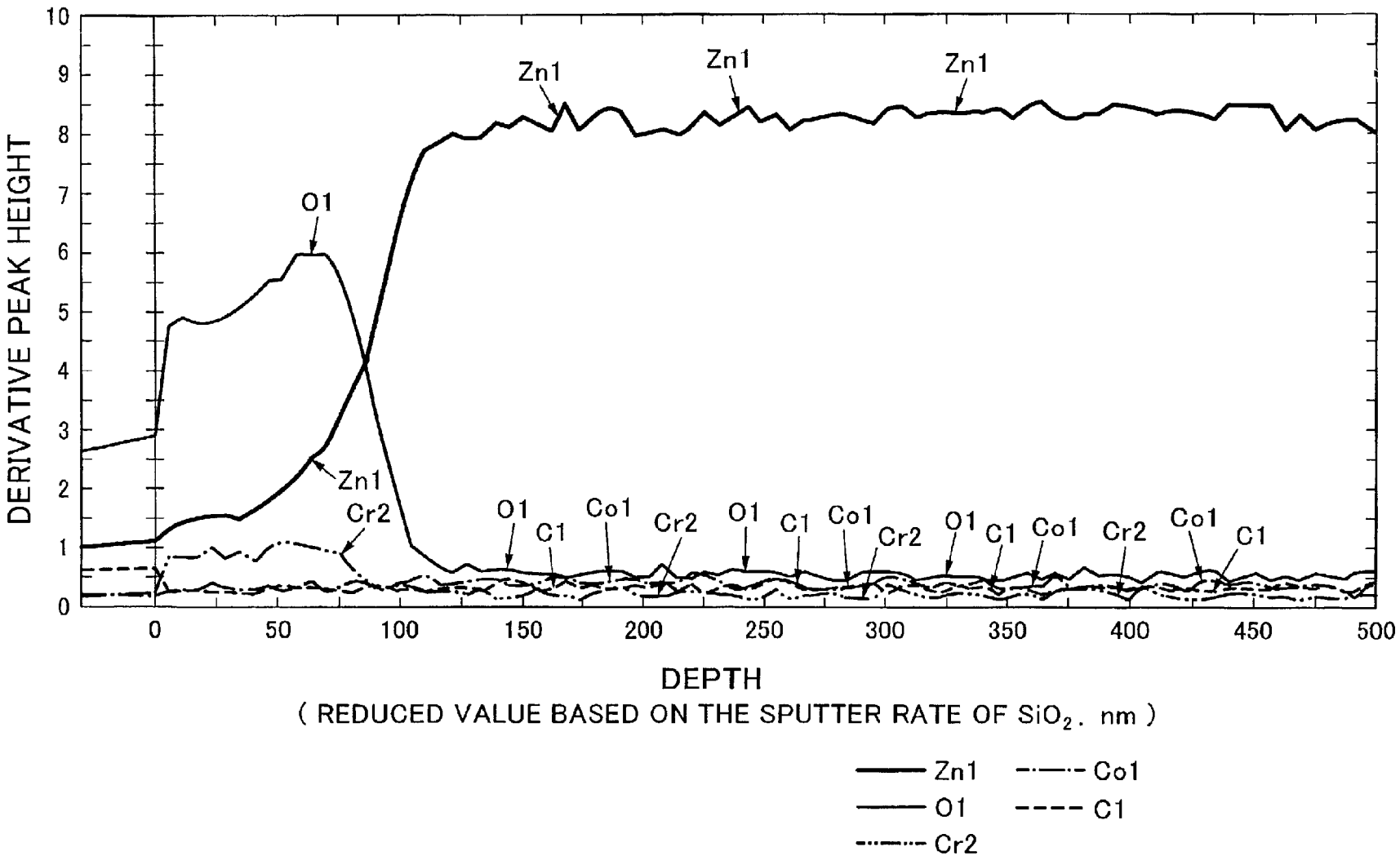
FIG. 2 is a chart showing the AES (Auger Electron Spectroscopy) analysis of the film according to the present invention.

In this connection, the thickness of the film was determined by the AES (Auger Electron Spectroscopy: FIG. 2) technique. In addition, the analysis of Cr, Co and oxalic acid were carried out by dissolving the film in methanesulfonic acid and inspecting the solution for the metals using a device: AA (Atomic Absorption spectrometer) and for oxalic acid according to the HPLC (High Performance Liquid Chromatography) technique.

As has been described above in detail, the present invention permits the formation of a trivalent chromate film directly on zinc or zinc alloy plating layers. The plated article obtained according to this method has not only the corrosion resistance due to the zinc or zinc alloy plating as such, but also the excellent corrosion resistance due to the presence of the trivalent chromate film. Moreover, the processing solution used in the present invention comprises trivalent chromium in a low concentration and therefore, the present invention is quite advantageous from the viewpoint of the waste water treatment and production and processing cost. The film obtained by directly forming trivalent chromate on the plating possesses not only corrosion resistance, resistance to salt water and after heating resistance identical to those observed for the conventional hexavalent chromium-containing film, but also excellent resistance to after heating-corrosion, and therefore, the film of the present invention can widely be used in a variety of fields in the future.

The present invention will hereunder be described in more detail with reference to the following Examples and Comparative Examples, but the present invention is not restricted to these specific Examples at all.

EXAMPLES 1 TO 5

A steel plate, which had been plated with Zn in a thickness of 8 $\mu$m, was immersed in a trivalent chromate-containing processing solution having a composition as shown in the following Table 2 and then washed with water.

TABLE 2

| | Ex. No. | | | | |
|---|---|---|---|---|---|
| | 1 | 2 | 3 | 4 | 5 |
| $Cr^{3+}$ (g/L) | 1 | 3 | 3 | 5 | 5 |
| $NO_3^-$ (g/L) | 5 | 15 | 18 | 25 | 30 |
| $PO_4^-$ (g/L) | 0 | 0.3 | 0 | 0 | 1 |
| Oxalic acid (g/L) | 3 | 8 | 8 | 12 | 12 |
| $Co^{2+}$ (g/L) | 1 | 1 | 1 | 1 | 2 |
| pH of Processing Soln. | 2.0 | 2.0 | 2.0 | 1.8 | 2.2 |
| Processing Temp. (° C.) | 30 | 30 | 30 | 30 | 30 |
| Processing time (sec.) | 60 | 40 | 40 | 40 | 40 |

In Table 2, $Cr^{3+}$ sources used were $CrCl_3$ (in Examples 3 and 5) and $Cr(NO_3)_3$ (in Examples 1, 2 and 4); the oxalic acid used was dihydrate; and $Co^{2+}$ source used was $Co(NO_3)_2$. Further $NO_3^-$ sources used were $HNO_3$ (in Examples 1, 2 and 4) and $NaNO_3$ (in Examples 3 and 5). The balance of each processing solution was water. Moreover, the pH value of each solution was adjusted using NaOH.

EXAMPLES 6 TO 10

A steel plate, which had been plated with Zn in a thickness of 8 $\mu$m, was immersed in a trivalent chromate-containing processing solution having a composition as shown in the following Table 3. The steel plate was once dried after the treatment and the steel plate was further heated at 200° C. for 2 hours to thus examine the corrosion resistance after heating.

TABLE 3

| | Ex. No. | | | | |
|---|---|---|---|---|---|
| | 6 | 7 | 8 | 9 | 10 |
| $Cr^{3+}$ (g/L) | 4 | 4 | 4 | 4 | 4 |
| $NO_3^-$ (g/L) | 20 | 20 | 20 | 20 | 20 |
| Oxalic acid (g/L) | 12 | 12 | 12 | 12 | 12 |
| $Co^{2+}$ (g/L) | 0.5 | 1 | 2 | 4 | 8 |
| pH of Processing Soln. | 2.2 | 2.2 | 2.2 | 2.2 | 2.2 |
| Processing Temp. (° C.) | 30 | 30 | 30 | 30 | 30 |
| Processing time (sec.) | 40 | 40 | 40 | 40 | 40 |

In Table 3, the $Cr^{3+}$ source used was $Cr(NO_3)_3$; the oxalic acid used was dihydrate; and the $Co^{2+}$ source used was $Co(NO_3)_2$. Further the $NO_3^-$ source used was $NaNO_3$. The balance of each processing solution was water. Moreover, the pH value of each solution was adjusted using NaOH.

EXAMPLES 11 TO 13

After the trivalent chromate treatment in Example 3, the steel plate was subjected to a topcoating treatment. The conditions for the topcoating treatment used herein are summarized in the following Table 4.

TABLE 4

| | Ex. No. | | |
|---|---|---|---|
| | 11 | 12 | 13 |
| Kind of Topcoat Concn. Of Processing Soln. | Silicate type inorganic film 200 mL/L | Polyurethane type organic film 100 mL/L | Methacrylic resin type organic film Stock solution was used as such |
| Processing Conditions | 45° C. - 45 sec | 25° C. - 60 sec | 25° C. - 60 sec |
| Name and Origin of Reagent | CC-445 available from Dipsol Chemicals Co., Ltd. | SUPERFLEX R3000 available from Daiichi Kogyo Seiyaku Co., Ltd. | DIPCOAT W available from Dipsol Chemicals Co., Ltd. |

COMPARATIVE EXAMPLE 1

A steel plate, which had been plated with zinc in a thickness of 8 μm, was subjected to a hexavalent chromate treatment. The hexavalent chromate bath used herein was Z-493 (10 mL/L) available from Dipsol Chemicals Co., Ltd.

COMPARATIVE EXAMPLE 2

A steel plate, which had been plated with zinc in a thickness of 8 μm, was subjected to a trivalent chromate treatment using a processing solution having the following composition: 15 g/L (3.3 g/L as expressed in terms of $Cr^{3+}$) of $Cr(NO_3)_3$; 10 g/L of $NaNO_3$; and 10 g/L of oxalic acid dihydrate (pH: 2.0, adjusted using NaOH). In this respect, the processing was carried out at 30° C. for 40 seconds.

COMPARATIVE EXAMPLE 3

A steel plate, which had been plated with zinc in a thickness of 8 μm, as a comparative example, was subjected to a trivalent chromate treatment using a processing solution having the following composition as disclosed in the example of J.P. KOKAI No. 2000-509434: 50 g/L (9.8 g/L as expressed in terms of $Cr^{3+}$) of $CrCl_3.6H_2O$; 3 g/L (1.0 g/L as expressed in terms of Co) of $Co(NO_3)_2$; 100 g/L of $NaNO_3$; and 31.2 g/L of malonic acid (pH: 2.0, adjusted using NaOH). In this respect, the processing was carried out at 30° C. for 40 seconds.

Processing Steps

In these Examples and Comparative Examples, the details of the processing steps are as follows:

Plating→Water Rinsing→Activation with Dilute Nitric Acid→Water Rinsing→Trivalent Chromate Treatment→Water Rinsing→(Topcoating Treatment)[1]→Drying[2]→(Heat Treatment)[3]

Note 1: This step was used only when the steel plate was subjected to a topcoating treatment.

Note 2: The drying step was carried out at a temperature ranging from 60 to 80° C. for 10 minutes.

Note 3: When carrying out the test for the corrosion resistance after heating, each steel plate was treated at 200° C. for 2 hours.

Salt Spray Test for Determining General Corrosion Resistance

The zinc plated steel plates obtained in Examples 1 to 5 and 11 to 13, and Comparative Examples 1 to 3 and each provided thereon with a trivalent chromate film were inspected for the appearance and subjected to the salt spray test (JIS-Z-2371). The results thus obtained are summarized in the following Table 5. As will be clear from the data listed in Table, it is found that even the films obtained in Examples 1 to 5 show the corrosion resistance almost identical or superior to those observed for the conventional chromate film (Comparative Example 1) and for the films obtained in Comparative Examples 2 and 3. In addition, the films of Examples 11 to 13, which were subjected to a topcoating treatment show corrosion resistance superior to that observed for the conventional chromate film.

TABLE 5

Results of Salt Spray Test (JIS-Z-2371) for Determining General Corrosion Resistance

| Ex. No. | Appearance of Film | Corrosion Resistance (1) (hr.) | Remarks |
|---|---|---|---|
| 1 | Pale Blue | 240 | 30° C. - 60 seconds |
| 2 | Pale Blue | 300 | 30° C. - 40 seconds |
| 3 | Pale Blue | 300 | 30° C. - 40 seconds |
| 4 | Pale Blue | 300 | 30° C. - 40 seconds |
| 5 | Pale Blue | 300 | 30° C. - 40 seconds |
| 11 | Milky White | Not less than 1000 | Possessing Topcoat |
| 12 | Milky White | Not less than 1000 | Possessing Topcoat |
| 13 | Milky White | Not less than 1000 | Possessing Topcoat |
| 1* | Reddish Green | 240 | 25° C. - 30 seconds |
| 2* | Pale Blue | 24 | 30° C. - 40 seconds |
| 3* | Purply Reddish Green | 72 | 30° C. - 40 seconds |

(1) Time (hour) required for the formation of white rust (5% by mass).
*Comparative Example Salt Spray Test for Examining Resistance to Heat Corrosion Moreover, the trivalent chromate films obtained in Examples 6 to 10 were inspected for the corrosion resistance after heating by the salt spray test (JIS-Z-2371) and for the cobalt contents of these films. The results thus obtained are summarized in the following Table 6. The data listed in Table 6 clearly indicate that the corrosion resistance after heating is improved as the cobalt content increases. For the purpose of comparison, the films obtained in Comparative Examples 1 and 3 were likewise subjected to the salt spray test for determining the corrosion resistance after heating.

Incidentally, the following Table 7 shows the contents of zinc, chromium, cobalt and oxalic acid in the chromate films obtained in Examples 6 to 10 and Comparative Examples 1 and 3 and the thicknesses of these films.

TABLE 6

Results obtained in Salt Spray Test for Determination of Corrosion Resistance after Heating

| Ex. No. | Appearance of Film | Corrosion Resistance (1) (hr.) | Content of Co (2) (g/L) |
|---|---|---|---|
| 6 | Pale Blue | 24 | 0.5 |
| 7 | Pale Blue | 240 | 1 |
| 8 | Pale Blue | 300 | 2 |
| 9 | Pale Blue | 360 | 4 |
| 10 | Pale Blue | 360 | 8 |
| 1* | Reddish Green | 24 | 0 |
| 3* | Purply Reddish Green | 48 | 1.0 |

(1) Time (hour) required for the formation of white rust (5% by mass).
(2) The cobalt content in the processing solution.
*Comparative Example

TABLE 7

| Contents of Zinc, Chromium, Cobalt and Oxalic Acid and Thickness of Films | | | | | |
|---|---|---|---|---|---|
| Ex. No. | Zn Content ($mg/dm^2$) | Cr/(Cr + Zn) (mass ratio) | Co/(Cr + Co) (mass ratio) | $C_2O_4$/($C_2O_4$ + Cr) (mass ratio) | Film Thickness ($\mu m$) |
| 6 | 1.50 | 25/100 | 5.7/100 | 9.1/100 | 0.07 |
| 7 | 1.50 | 25/100 | 12.3/100 | 19.4/100 | 0.08 |
| 8 | 1.50 | 25/100 | 20.6/100 | 28.6/100 | 0.08 |
| 9 | 1.50 | 23/100 | 30.8/100 | 43.0/100 | 0.09 |
| 10 | 1.50 | 21/100 | 36.5/100 | 46.7/100 | 0.09 |
| 1* | 4.30 | 39/100 | 0.0/100 | 0.0/100 | 0.30 |
| 3* | 2.20 | 31/100 | 2.9/100 | 0.0/100 | 0.10 |

*Comparative Example

As a result of various investigations, it has been found that adding cobalt to the processing solution rather than increasing the thickness of the film by changing the pH value or the trivalent chromium concentration can improve the corrosion resistance of the chromate film. This fact will be detailed below.

Effect of Addition of Cobalt

The effects of the presence of cobalt in the processing solution on the content of cobalt and the thickness of the resulting film as well as the corrosion resistance thereof, observed when the pH value of the processing solution was changed, were examined using the processing solution prepared in Example 8 to make clear the effect of the addition of cobalt on the improvement of the corrosion resistance. The pH value was controlled using NaOH. The results thus obtained are summarized in the following Tables 8 and 9.

As a result, it was found that the corrosion resistance of the film to which cobalt had been incorporated did not show any drastic change even when the pH value of the solution was changed and the cobalt-containing film showed excellent corrosion resistance as compared with that observed for the film free of any cobalt. Moreover, it was also found that the corrosion resistance was proportional to the cobalt content rather than the thickness of the film.

TABLE 8

| Effect Observed When any Cobalt is not added | | | |
|---|---|---|---|
| pH of Processing Solution | Cobalt Content ($mg/dm^2$) | Thickness of Film ($\mu m$) | Time (1) (hr.) |
| 1.4 | 0 | 0.08 | Not more than 24 |
| 1.6 | 0 | 0.10 | Not more than 24 |
| 1.8 | 0 | 0.10 | Not more than 24 |
| 2.0 | 0 | 0.09 | 24 |
| 2.2 | 0 | 0.07 | 24 |
| 2.4 | 0 | 0.06 | 24 |
| 2.6 | 0 | 0.06 | 24 |

(1) Time (hour) required for the formation of white rust (5%).
(Processing temperature: 30° C.; processing time: 40 seconds).

TABLE 9

| Effect Observed When 2 g/L of Cobalt was added | | | |
|---|---|---|---|
| pH of Processing Solution | Cobalt Content ($mg/dm^2$) | Thickness of Film ($\mu m$) | Time (1) (hr.) |
| 1.4 | 0.06 | 0.08 | 120 |
| 1.6 | 0.08 | 0.10 | 240 |
| 1.8 | 0.10 | 0.10 | 240 |

TABLE 9-continued

| Effect Observed When 2 g/L of Cobalt was added | | | |
|---|---|---|---|
| pH of Processing Solution | Cobalt Content ($mg/dm^2$) | Thickness of Film ($\mu m$) | Time (1) (hr.) |
| 2.0 | 0.11 | 0.09 | 300 |
| 2.2 | 0.13 | 0.08 | 300 |
| 2.4 | 0.11 | 0.06 | 300 |
| 2.6 | 0.11 | 0.06 | 240 |

(1) Time (hour) required for the formation of white rust (5%).
(Processing temperature: 30° C.; processing time: 40 seconds).

Effect of Trivalent Chromium Concentration Change on Corrosion Resistance

To examine the effect of the trivalent chromium concentration in the processing solution on the corrosion resistance of the resulting trivalent chromium, the processing solution of Example 1 was used as a sample having a chromic acid concentration of 1 g/L and the trivalent chromium concentrations of other samples of processing solutions were adjusted by addition of $Cr(NO_3)_3$ to the processing solution prepared in Example 8. Further the pH values of these samples were adjusted to a constant level (pH 2.2) and changes in the film thicknesses and the corrosion resistance were examined. Simultaneously, the presence of cobalt in the resulting film was likewise examined. The pH value was controlled using NaOH. The results thus obtained are summarized in the following Tables 10 and 11.

As a result, it was found that the addition of cobalt to the processing solution is more effective for the improvement of the corrosion resistance of the resulting chromate film than the increase of the thickness of the chromate film by increasing the trivalent chromium concentration in the processing solution.

TABLE 10

| Effect Observed When any Cobalt was not added | | |
|---|---|---|
| Trivalent Chromium Concn. ($Cr^{3+}$ g/L) | Film Thickness ($\mu m$) | Time (1) (hr.) |
| 1 | 0.05 | Not less than 24 |
| 4 | 0.07 | 24 |
| 8 | 0.09 | Not less than 24 |
| 12 | 0.11 | Not less than 24 |
| 16 | 0.12 | Not less than 24 |

(1) Time (hour) required for the formation of white rust (5%).
(Processing temperature: 30° C.; processing time: 40 seconds).

TABLE 11

| Effect Observed When 2 g/L of Cobalt was added | | |
|---|---|---|
| Trivalent Chromium Concn. ($Cr^{3+}$ g/L) | Film Thickness ($\mu m$) | Time (1) (hr.) |
| 1 | 0.06 | 240 |
| 4 | 0.08 | 300 |
| 8 | 0.09 | 300 |
| 12 | 0.12 | 300 |
| 16 | 0.13 | 300 |

(1) Time (hour) required for the formation of white rust (5%).
(Processing temperature: 30° C.; processing time: 40 seconds).

What is claimed is:

1. A method for forming a hexavalent chromium free, corrosion resistant, trivalent chromate conversion film comprising:

the step of bringing zinc or zinc alloy plating layers into contact with a processing solution comprising trivalent chromium and oxalic acid in a molar ratio ranging from 0.5/1 to 1.5/1, wherein the trivalent chromium is present in the form of a water-soluble complex with oxalic acid, and cobalt ions, which are stably present in the processing solution without causing any precipitation due to formation of a metal salt of oxalic acid;

wherein the solution reacts with zinc to form a hexavalent chromium free, corrosion resistant, trivalent chromate conversion film containing zinc, trivalent chromium, cobalt and oxalic acid on the plating.

2. The method according to claim 1 wherein, in the processing solution, molar ratio of trivalent chromium to oxalic acid ranges from 0.8/1 to 1.3/1.

3. The method according to claim 1 wherein, in the processing solution, the trivalent chromium concentration ranges from 0.2 to 5 g/L, the oxalic acid concentration ranges from 0.2 to 13 g/L and the cobalt ion concentration ranges from 0.2 to 10 g/L.

4. The method according to claim 1 wherein the processing solution further comprises 1 to 50 g/L of an inorganic salt selected from the group consisting of inorganic salts of nitric acid, sulfuric acid and hydrochloric acid.

5. The method according to claim 1 wherein the processing solution has pH of0.5 to 4.

6. The method according to claim 1 wherein, in the processing solution, molar ratio of trivalent chromium to oxalic acid ranges from 0.8/1 to 1.3/1; the trivalent chromium concentration ranges from 0.2 to 5 g/L, the oxalic acid concentration ranges from 0.2 to 13 g/L and the cobalt ion concentration ranges from 0.2 to 10 g/L;

the processing solution further comprises 1 to 50 g/L of an inorganic salt selected from the group consisting of inorganic salts of nitric acid, sulfuric acid and hydrochloric acid; pH ranges from 0.5 to 4.

7. The method according to claim 1 wherein the step of contacting is conducted at a temperature of the solution of 10 to 40° C. for 5 to 600 seconds.

8. A method for forming a hexavalent chromium free, corrosion resistant, trivalent chromate conversion film comprising the steps of:

immersing zinc or zinc alloy plating layers into a dilute nitric acid solution and then water rinsing;

subjecting the zinc or zinc alloy plating layers to immersion in a processing solution and then water rinsing, wherein the processing solution comprises trivalent chromium and oxalic acid in a molar ratio ranging from 0.5/1 to 1.5/1, wherein the trivalent chromium is present in the form of a water-soluble complex with oxalic acid, and cobalt ions, which are stably present in the processing solution without causing any precipitation due to formation of a metal salt of oxalic acid; and drying the resultant;

wherein the solution reacts with zinc to form a hexavalent chromium free, corrosion resistance, trivalent chromate film containing zinc, trivalent chromium, cobalt and oxalic acid on the plating.

9. The method according to claim 8 wherein, in the processing solution, molar ratio of trivalent chromium to oxalic acid ranges from 0.8/1 to 1.3/1; the trivalent chromium concentration ranges from 0.2 to 5 g/L, the oxalic acid concentration ranges from 0.2 to 13 g/L and the cobalt ion concentration ranges from 0.2 to 10 g/L;

the processing solution further comprises 1 to 50 g/L of an inorganic salt selected from the group consisting of inorganic salts of nitric acid, sulfuric acid and hydrochloric acid;

pH ranges from 0.5 to 4.

10. The method according to claim 8 wherein the step of immersing is conducted at a temperature of the solution of 10 to 40° C. for 5 to 600 seconds.

11. The method according to claim 8 wherein the step of immersing is conducted at a temperature of the solution of 20 to 30° C. for 20 to 60 seconds.

12. The method according to claim 8 wherein the step of immersing is conducted at a temperature of the solution of 10 to 40° C. for 5 to 600 seconds and the step of drying is conducted at a temperature of 60 to 80 for 10 minutes.

13. The method according to claim 8 wherein, before or after the step of drying, further a topcoat film is applied onto the hexavalent chromium free, corrosion resistant, trivalent chromate conversion film.

14. The method according to claim 8 which, before or after the step of drying, further comprises applying an topcoat film onto the hexavalent chromium free, corrosion resistant, trivalent chromate conversion film by immersing the film in a topcoating solution comprising one member selected from the group consisting of a silicate or a phosphoric acid salt, polyethylene, polyvinyl chloride, polystyrene, polypropylene, methacrylic resin, polycarbonate, polyamide, polyacetal, fluorine plastic, urea resin, phenolic resin, unsaturated polyester resin, polyurethane, alkyd resin, epoxy resin and melamine resin.

15. The method according to claim 14 wherein the topcoating solution comprises one member selected from the group consisting of a silicate acid salt, methacrylic resin and polyurethane.

16. A method for forming a colored hexavalent chromium free, corrosion resistant, trivalent chromate conversion film comprising:

the step of bringing zinc or zinc alloy plating layers into contact with a processing solution comprising trivalent chromium and oxalic acid in a molar ratio ranging from 0.5/1 to 1.5/1, wherein the trivalent chromium is present in the form of a water-soluble complex with oxalic acid; and cobalt ions, which are stably present in the processing solution without causing any precipitation due to formation of a metal salt of oxalic acid further containing a dye, or the steps of bringing zinc or zinc alloy plating layers into contact with said processing solution and then applying to the resultant a solution containing a dye.

* * * * *

UNITED STATES PATENT AND TRADEMARK OFFICE

CERTIFICATE OF CORRECTION

PATENT NO. : 6,858,098 B2
DATED : February 22, 2005
INVENTOR(S) : Oshima et al.

It is certified that error appears in the above-identified patent and that said Letters Patent is hereby corrected as shown below:

Title page,
Change to Item -- [45] **Date of Patent: *Feb. 22, 2005**
[*] Notice: Subject to any disclaimer, the term of this patent is extended or adjusted under 35 U.S.C. 154(b) by 0 days.

This patent is subject to a terminal disclaimer. --.

Signed and Sealed this

Twenty-third Day of August, 2005

JON W. DUDAS
*Director of the United States Patent and Trademark Office*

US006858098C1

(12) EX PARTE REEXAMINATION CERTIFICATE (9112th)

United States Patent

Oshima et al.

(10) Number: US 6,858,098 C1

(45) Certificate Issued: *Jul. 3, 2012

(54) PROCESSING SOLUTION FOR FORMING HEXAVALENT CHROMIUM FREE AND CORROSION RESISTANT CONVERSION FILM ON ZINC OR ZINC ALLOY PLATING LAYERS, HEXAVALENT CHROMIUM FREE AND CORROSION RESISTANT CONVERSION FILM, METHOD FOR FORMING THE SAME

(75) Inventors: Katsuhide Oshima, Tokyo (JP); Shigemi Tanaka, Tokyo (JP); Manabu Inoue, Tokyo (JP); Tomitaka Yamamoto, Tokyo (JP)

(73) Assignee: Dipsol Chemicals Co., Ltd., Kyobashi, Chuo-Ku, Tokyo (JP)

Reexamination Request:
No. 90/009,967, Nov. 8, 2011

Reexamination Certificate for:

| | |
|---|---|
| Patent No.: | **6,858,098** |
| Issued: | **Feb. 22, 2005** |
| Appl. No.: | **10/085,083** |
| Filed: | **Mar. 1, 2002** |

( * ) Notice: This patent is subject to a terminal disclaimer.

Certificate of Correction issued Aug. 23, 2005.

(30) Foreign Application Priority Data

Nov. 30, 2001 (JP) ..... 2001-366717

(51) Int. Cl.

| | |
|---|---|
| ***B05D 7/14*** | (2006.01) |
| ***C23C 22/30*** | (2006.01) |
| ***C23C 22/46*** | (2006.01) |
| ***C23C 22/47*** | (2006.01) |
| ***C23C 22/05*** | (2006.01) |

(52) U.S. Cl. ..... 148/267; 148/265

(58) Field of Classification Search ..... None
See application file for complete search history.

(56) References Cited

To view the complete listing of prior art documents cited during the proceeding for Reexamination Control Number 90/009,967, please refer to the USPTO's public Patent Application Information Retrieval (PAIR) system under the Display References tab.

*Primary Examiner*—Alan Diamond

(57) ABSTRACT

A processing solution for forming a hexavalent chromium free, corrosion resistant trivalent chromate conversion film on zinc or zinc alloy plating layers comprises: trivalent chromium and oxalic acid in a molar ratio ranging from 0.5/1 to 1.5/1, wherein the trivalent chromium is present in the form of a water-soluble complex with oxalic acid; and cobalt ions, which do not form a hardly soluble metal salt with oxalic acid and are stably present in the processing solution without causing any precipitation; wherein the solution reacts with zinc when bringing it into contact with the zinc or zinc alloy plating to form a hexavalent chromium free, corrosion resistant, trivalent chromate conversion film containing zinc, chromium, cobalt, oxalic acid and silicon on the plating. The film is quite thin, free of any hexavalent chromium, has corrosion resistance identical to or higher than that achieved by the conventional hexavalent chromium-containing film and can be formed using a processing solution having a quite low concentration.

EX PARTE REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1-16 is confirmed.

* * * * *